US006703777B2

(12) United States Patent
Nakamura et al.

(10) Patent No.: US 6,703,777 B2
(45) Date of Patent: Mar. 9, 2004

(54) ADJUSTING METHOD FOR CATHODE POSITION OF AN ELECTRON GUN AND AN ELECTRON GUN FOR A CATHODE RAY TUBE

(75) Inventors: Hirofumi Nakamura, Aichi (JP); Hideki Miyazaki, Aichi (JP); Yoshio Fuwa, Aichi (JP); Hiroshi Ushida, Aichi (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 10/023,647

(22) Filed: Dec. 21, 2001

(65) Prior Publication Data

US 2002/0084740 A1 Jul. 4, 2002

(30) Foreign Application Priority Data

Dec. 22, 2000 (JP) ..... P2000-391470

(51) Int. Cl.[7] ..... H01J 29/46

(52) U.S. Cl. ..... 313/446

(58) Field of Search ..... 313/446

(56) References Cited

U.S. PATENT DOCUMENTS 5,402,035 A * 3/1995 Lee ..... 313/456
5,818,161 A * 10/1998 Park ..... 313/446
6,281,624 B1 * 8/2001 Koshigoe et al. ..... 313/451
6,396,202 B2 * 5/2002 Sugawara et al. ..... 313/270

* cited by examiner

*Primary Examiner*—Renee Luebke
*Assistant Examiner*—Ann McCamey
(74) *Attorney, Agent, or Firm*—Rader, Fishman & Grauer PLLC; Ronald P. Kananen

(57) ABSTRACT

In an adjusting method for a cathode position of an electron gun, an apex point of a dome-shaped cathode is detected and then a positional adjustment is executed by moving a first grid in a X-Y direction so that a center of a grid aperture is coincided with the position of the apex point, at first. Next, a sleeve ring and a collar portion of a sleeve holder are welded together by a laser beam. The a dgk-vale adjustment is done so as for a gap between first grid and apex point of the cathode to be a predetermined value and welded by irradiating the laser beam to a superposed position of the cathode structure and the sleeve. According to the present invention, these positioning adjustment and the dgk-value adjustment are able to be executed independently.

3 Claims, 6 Drawing Sheets

ADJUSTING METHOD FOR CATHODE POSITION OF AN ELECTRON GUN AND AN ELECTRON GUN FOR A CATHODE RAY TUBE

CROSS REFERENCES TO RELATED APPLICATIONS

The present invention claims priority to the priority document, Japanese Patent Application No. P2000-391470 filed in Japan on Dec. 22, 2000, and incorporated by reference herein.

BACKGROUND OF THE INVENTION

1. Field of the Invention

This invention relates to an adjusting method for cathode position of an electron gun and a electron gun for a cathode ray tube. More particularly, after a positional adjustment is executed for a position of an apex point of a cathode to become a center of a grid aperture of a first grid, an adjustment for a distance between the cathode and the first grid is independently executed, and accordingly even a cathode having a dome shaped surface can be fixed to a right position relative to the aperture of the first grid with higher precision.

2. Description of the Related Art

An electron gun of a cathode ray tube is so constructed, for example as shown in FIG. 9, as to be mechanically linked and supported with a predetermined positional relation mutually by fixing a cylindrical shaped first grid 11, a second grid 12, a third grid 13, a forth grid 14 and a fifth grid 15 to a beading glass 16, respectively.

Further a cylindrical cathode structure 30 is positioned within the first grid 11 and a cathode 31 is provided on a top surface of the cathode structure 30. In this case, when the cathode structure 30 is assembled within the first grid 11, a grid aperture 11*h* provided at the first grid 11 and the cathode structure 30 are adjusted to be coaxial and further, a gap between the first grid 11 and the cathode 31 to be a predetermined value (it is called as a dgk-value adjustment).

Further a test for improving focus characteristics has been done by employing a cathode having a dome shaped surface such as an impregnate type cathode, for example, and by minimizing a work area of a cathode due to concentration of an electronic field from a first grid.

In a case when the surface of the cathode 31 is formed to be dome shaped, a position of the apex point of the dome shaped cathode may have dispersion at every cathode.

When the grid aperture 11*h* and the cathode structure 30 are adjusted to be coaxial, it sometimes occurs that the position of the apex point and a center of the grid aperture 11*h* are not coincided due to such dispersion of the apex point the cathode 31.

When the position of the apex point and the center of the grid aperture 11*h* are not coincided, a track of a beam emitted from the cathode 31 is bent and it causes the problems that the shift amount of the spot formed on a phosphor screen of the cathode ray tube becomes large.

Further the surface of the cathode 31 is dome shaped, so that if it is not precisely adjusted for the gap between the apex point and the first grid 11 to be a predetermined space by properly detecting the position of the apex point of the cathode surface, the gap between the first grid 11 and the cathode 31 may have dispersion, and it causes a problem in which cut-off levels of R, G and B beams have dispersion due to such dispersion of the gaps.

SUMMARY OF THE INVENTION

According to the present invention, an adjusting method for a cathode position of an electron gun is presented capable of properly adjusting a position of a cathode, although an impregnate type cathode is employed as a cathode.

The adjusting method of the present invention includes: a step for supporting a cathode structure at a cathode holder; a step for detecting a position of an apex point of the cathode of the cathode structure supported by the cathode holder; a step for fixing the cathode holder to a first grid after executing a position adjustment for the position of the apex point of the cathode to be a center of a grid aperture of the first grid; and a step for fixing the cathode holder and the cathode structure after executing the position adjustment of the detected position of the apex point of the cathode and the first grid to be a predetermined value.

Further an electron gun of a cathode ray tube of the present invention comprises: a cathode colder; a cathode structure supported by the cathode holder; a cathode constituting the cathode structure; and a first grid having a grid aperture; wherein an apex point of the cathode is fixed to be positioned to a center of the grid aperture of the first grid.

According to the present invention, a cathode structure having a cathode with a dome shaped surface is mounted within a cathode holder. A position of the apex point of the cathode in the cathode structure supported by the cathode holder is detected and then the cathode holder is fixed to the first grid after a position adjustment where a position of an apex point of the cathode is coincided with a center of the grid aperture of the first grid. Further the cathode holder and the cathode structure are fixed after executing the position adjustment in which the gap between the detected position of the apex point of the cathode and the first grid becomes a predetermined value.

DETAILED DESCRIPTION OF THE PREFERRED EMBODIMENTS

Here-in-after, one embodiment of the present invention is explained with reference to the attached drawings.

Figure 1A:
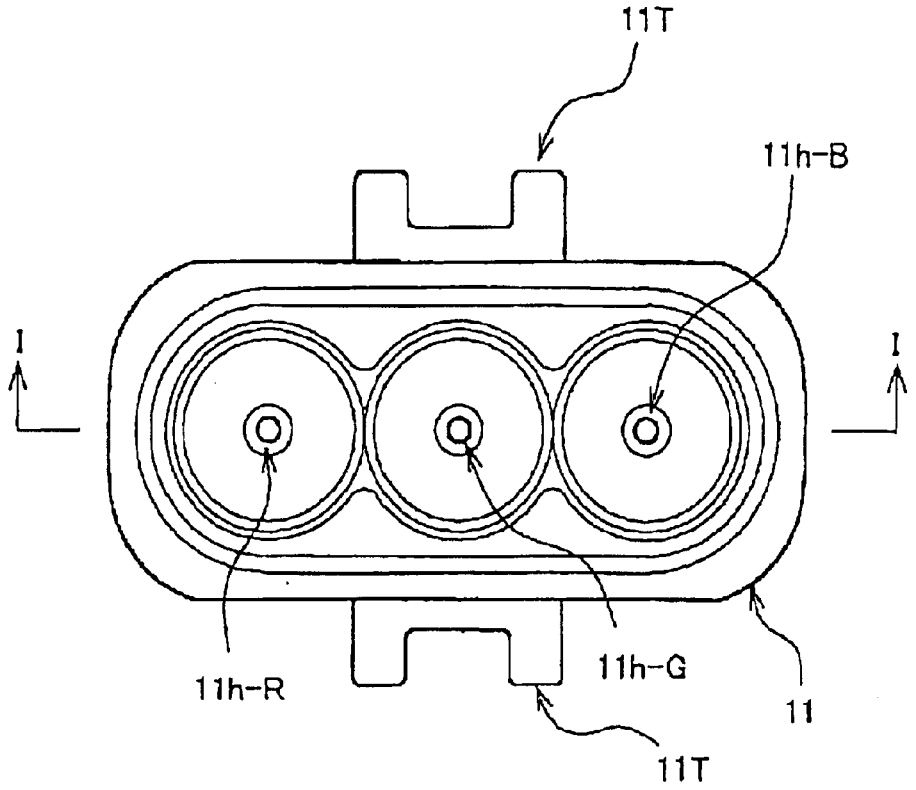
FIG. 1A is a top view of a first grid.

As shown in FIG. 1A, a first grid 11 has a grid aperture 11*h*-R for R (red) beam, a grid aperture 11*h*-G for G (green) beam and a grid aperture 11*h*-B for B (blue) beam. At a longer side portion of the first grid 11, a fixing terminal 11T is formed in a projected form, where the first grid 11 is bonded to a beading glass 16 when it is fixed to the beading glass 16.

Figure 1B:
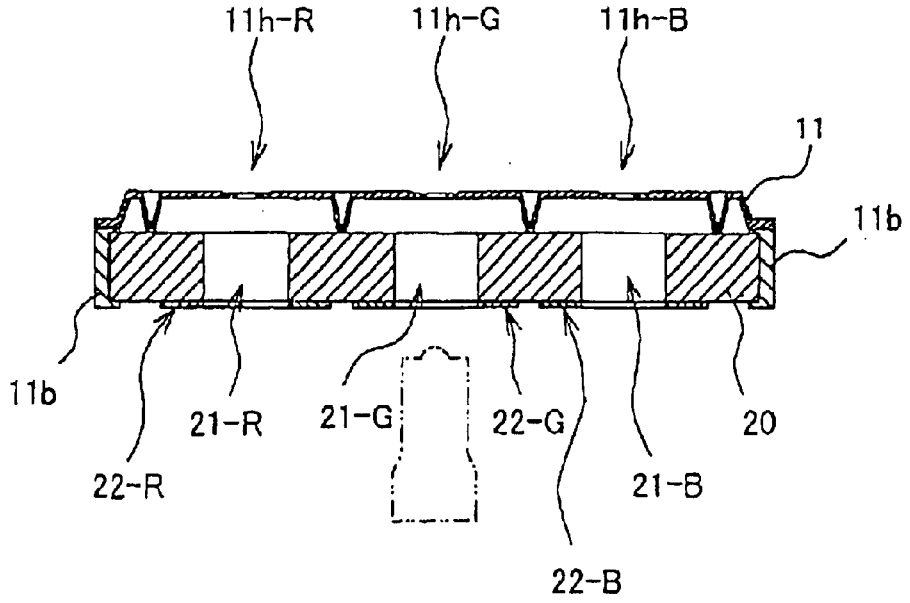
FIG. 1B is a sectional view of the first grid taken along a line I—I in FIG. 1A.

Further to the first grid 11, a substrate holder 11*b* is welded the first grid 11 to support a ceramic substrate 20 as shown in FIG. 1B. An insertion aperture 21-R for inserting a cathode structure 30 is provided at the ceramic substrate 20 at a position opposed to the grid aperture 11*h*-R for the R beam. Similarly, insertion apertures 21-G for G beam and 21-B for B beam for inserting respective cathode structures 30 (depicted by a two-dot-chain line) are provided at position opposed to the grid aperture 11*h*-G and grid aperture 11*h*-B. Further sleeve rings 22-R, 22-G and 22-B are provided on periphery of the insertion apertures 21-R, 21-G and 21-B, respectively at a face of the of the ceramic substrate 20, where the face is the other side to the face opposed to the first grid 11.

Figure 2:
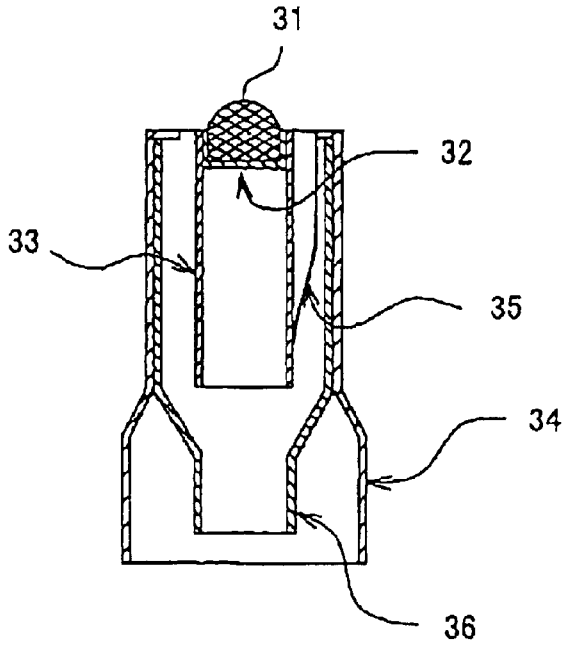
FIG. 2 is a schematic sectional view of a cathode structure.

FIG. 2 shows a schematic sectional view of the cathode structure 30 positioned within the first grid 11. Such impregnate type cathode 31 having a dome shaped surface is fixed to a cap 32 and further a first sleeve 33 is mounted on the cap 32.

Each end of three straps 35 is connected to one side of the first sleeve 33 at even interval and the each of other end of the straps 35 is connected to a tip of a second sleeve 34, respectively. Accordingly, when the first sleeve 33 to which the cathode 31 and the cap 32 are fixed is inserted into the second sleeve 34, the first sleeve 33 is supported by the strap 35 so as not to move in the direction perpendicular to an axial direction of the cathode structure 30. Further by fixing the other end of the strap 35 to the tip of the second sleeve 34, the first sleeve 33 is also kept unmoved to the axial direction of the cathode structure 30. The first sleeve 33 is supported by way of the strap 35, so that when the cathode 31 is heated by a heater that is mounted within the first sleeve 33, the heat is prevented from escaping to the second sleeve 34, and accordingly, the cathode 31 can be efficiently heated. A sleeve shield 36 is mounted inside of the second sleeve 34 to which the first sleeve 33 is connected by way of the strap 35.

Figure 3:
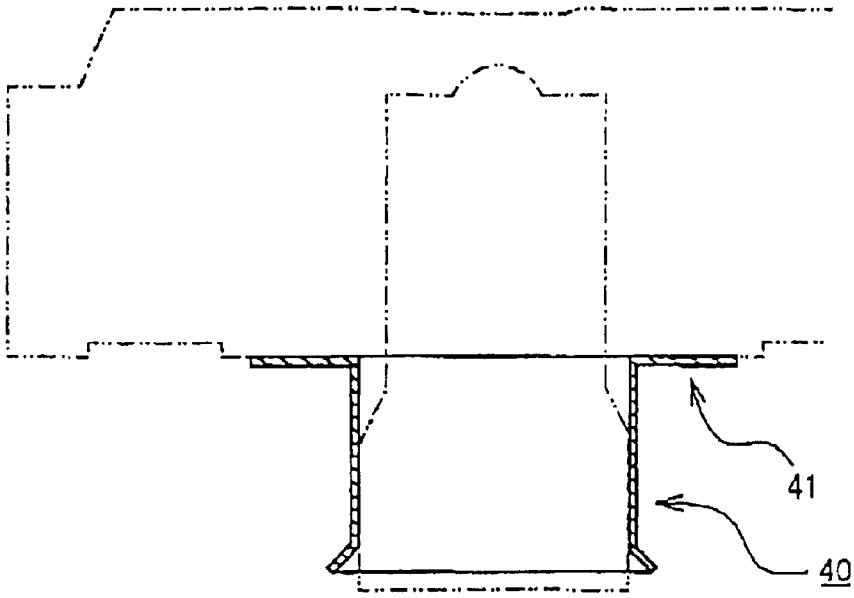
FIG. 3 is a sectional view of a sleeve holder.

FIG. 3 is a sectional view of a sleeve holder 40 for fixing a cathode structure 30-R for a R (red) beam, a cathode structure 30-G for a G (green) beam and a cathode structure 30-B for a B (blue) beam to the ceramic substrate 20, where the cathode structure 30-R, the cathode structure 30-G and the cathode structure 30-B are inserted into respective inserting apertures 21-R, 21-G, and 21-B of the ceramic substrate 20. The sleeve holder 40 is formed in a cylindrical shape and an inside diameter of the sleeve holder 40 is formed slightly larger than an outer diameter of the second sleeve 34 so as to slidably support the inserted cathode structure 30. Further a collar portion 41 to be welded to the sleeve ring 22 is formed at an end of the sleeve holder 40 that becomes a cathode side when the cathode structure 30 is inserted.

When the cathode structure 30 constructed as above is installed within the first grid 11 by way of the sleeve holder 40, a position of an apex point of the cathode 31 provided on top of the cathode structure 30 and a center of the grid aperture 11*h* are adjusted to be coincided to each other by a cathode fixing jig, and after that the cathode structure 30 is adjusted to be a right position so as for a gap between the apex point of the cathode 31 and the first grid 11 to be a predetermined value.

Figure 4A:
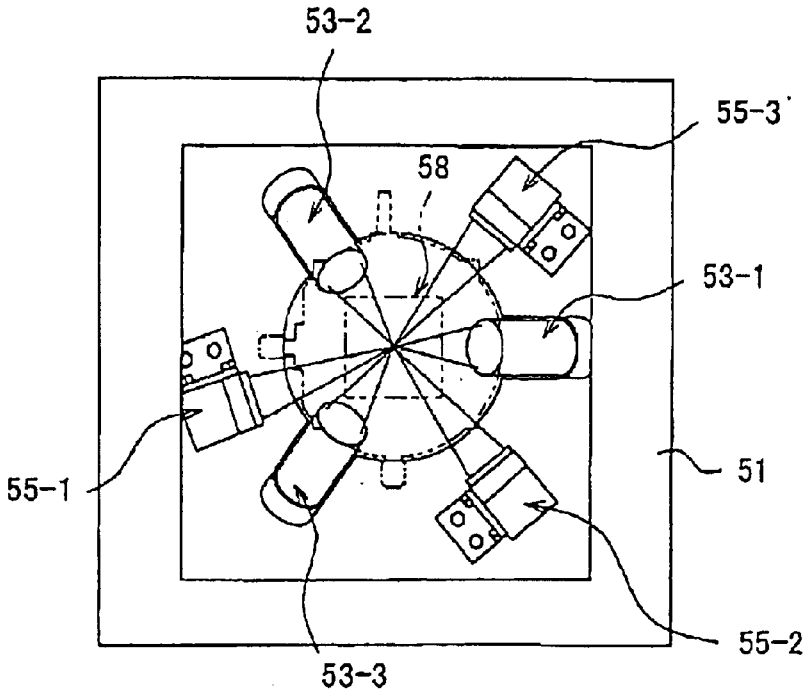
FIG. 4A is a top view of a cathode fixing jig.
Figure 4B:
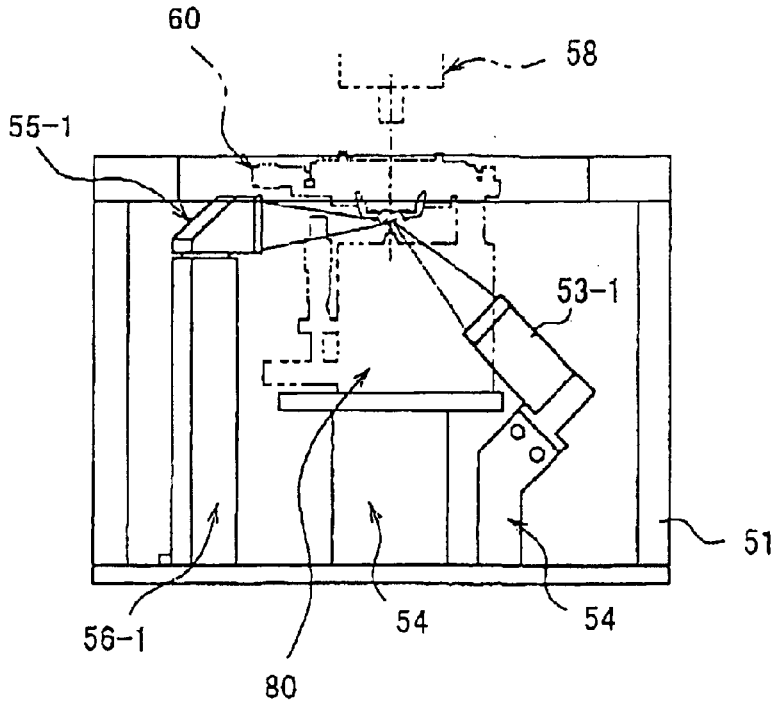
FIG. 4B is a side view of the cathode fixing jig in FIG. 4A.

FIG. 4A shows a schematic plan view of the cathode fixing jig and FIG. 4B is a schematic front view thereof. A two-dot-chain line in FIG. 4A and FIG. 4B designates respective positions of a measuring machine 58, an grid position adjustment jig 60 and a cathode structure supporting jig 80, and those will be described later. Further in this schematic front view in FIG. 4B, later-described laser output apparatuses 53-2, 53-3, 55-2 and 55-3 are neglected for simplifying the drawing.

The grid position adjustment jig 60 and a table 52 for mounting the cathode structure supporting jig 80 are provided on a frame 51 of the cathode fixing jig 50. Three laser output apparatus 53-1, 53-2 and 53-3 are provided, for example, for laser-welding the sleeve ring 22 on the ceramic substrate 20 and the collar portion 41 on the sleeve holder 40 around the table 52.

The laser output apparatus 53-1 is fixed on a supporting substrate 54-1 so as to irradiate the laser beam askew in an upward direction. In addition, a focus position of the laser beam is adjusted to be a junction face where the sleeve ring 22 of the ceramic substrate 20 supported by the grid position adjustment jig 60 and the collar portion 41 of the sleeve holder 40 supported by the cathode structure supporting jig 80 are in junction. Similarly the laser output apparatus 53-2 and 53-3 are also fixed so as to irradiate the laser beam askew in the upward direction, and also are adjusted to have a focus position at a junction face of the sleeve ring 22 and the collar portion 41.

Three laser output apparatus 55-1, 55-2 and 55-3 are provided around the table 52 for welding the second sleeve 34 and the sleeve holder 40 of the cathode structure 30, for example.

The laser output apparatus 55-1 is fixed to the supporting substrate 56-1 to irradiate the laser beam in a horizontal direction. A focusing position of the laser beam is adjusted to a superposed position of the second sleeve 34 of the cathode structure 30 supported by the cathode structure supporting jig 80 and the sleeve holder 40 mounted on the ceramic substrate 20. Similarly, the laser output apparatus 55-2 and 55-3 are also adjusted to irradiate the laser beam to the horizontal direction and the focus point of the laser beam is adjusted to a superposed position of the second sleeve 34 and the sleeve holder 40.

Further a measuring machine 58 is positioned above the grid position adjustment jig 60, wherein the measuring machine 58 detects the grid aperture 11*h* of the first grid 11 supported by the grid position adjustment jig 60 and the position of the apex point of the cathode structure 30 supported by the cathode structure supporting jig 80.

Figure 5:
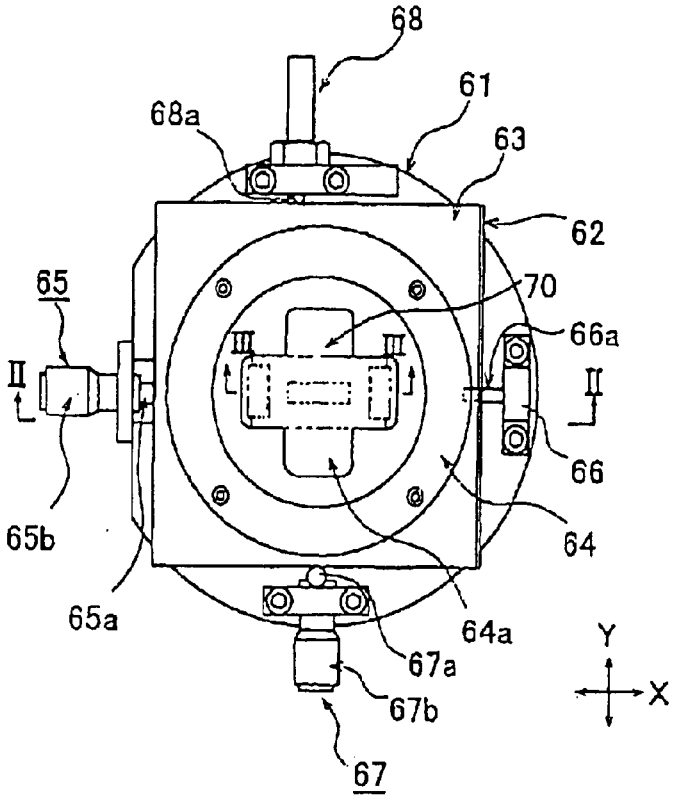
FIG. 5 is a plan view of a grid position adjustment jig.

FIG. 5 shows a schematic front view of the grid position adjustment jig 60.

The first table 62 is mounted on the base substrate 61 slidably in an X direction in the figure. Further the second table 63 is mounted on the first table 62 slidably in a Y direction in the figure. Further a table 64 having an opening 64*a* is fixedly mounted at the second table 63 for mounting the grid fixing member 70 (as shown by a two-dot-chain line in the figure). In this case, openings are provided at the base substrate 61, the first table 62 and the second table 63 corresponding to a position of the opening 64*a* of the table 64.

A position adjustment apparatus such as a micro-meter 65 is provided at one side of the first table 62 by fixing on the base substrate 61, where such side of the first table 62 is perpendicular to the X direction. A spindle 65*a* of the micro-meter 65 is impinged on a side end face of the first table 62. Further a pressing portion 66 fixed to the base substrate 61 is provided and a shaft 66*a* of the pressing portion 66 is impinged on the side end face of the first table 62 and then the first table 62 is pressed against the micro-meter 65. Accordingly, the position of the grid fixing member 70 can be adjusted minutely in the X direction by rotating a thimble 65*b* of the micro-meter 65 so as to vary a protruding amount of the spindle 65*a*.

A position adjustment apparatus such as a micro-meter 67 is provided at one side of the second table 63 by fixing on the base substrate 61, where the side of the second table 63 is perpendicular to the X direction. A spindle 67*a* of the micro-meter 67 is impinged on a side end face of the second table 63. Further a pressing portion 68 fixed to the base substrate 61 is provided and a shaft 68*a* of the pressing portion 68 is impinged on the side end face of the second table 63 and the second table 63 is pressed against the micro-meter 67. Accordingly, the position of the grid fixing member 70 can be adjusted minutely in the X direction by rotating a thimble 67*b* of the micro-meter 67 so as to vary a protruding amount of the spindle 67*a*.

Figure 6:
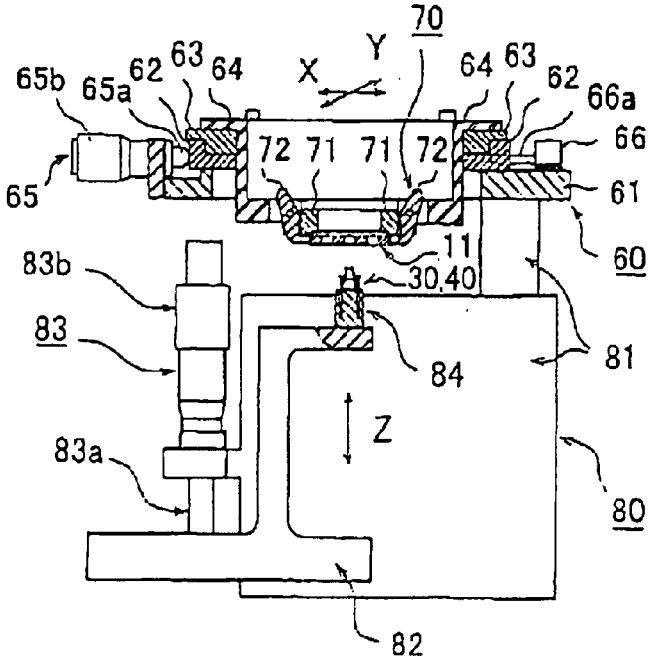
FIG. 6 is a sectional view of the grid position adjustment jig taken along a line II—II in FIG. 5 and a cathode structure supporting jig.

Thus constructed grid position adjustment jig 60 is mounted and fixed to a base substrate 81 of a cathode structure supporting jig 80 as shown in FIG. 6. In this case, FIG. 6 shows a schematic view of the grid position adjustment jig 60 taken along a line II—II in FIG. 5. Further a schematic sectional view of the opening of the table 64 taken along a line III—III is also depicted.

An elevating desk 82 is mounted on the base substrate 81 slidably in the vertical direction (a Z direction in the figure). Further a micro-meter 83 is fixedly mounted on the base substrate 81 as the position adjustment apparatus and the spindle 83*a* of the micro-meter 83 is fixed to the elevating desk 82. Further a supporting portion 84 is provided on an upper surface of the elevating desk 82 for supporting the cathode structure 30 and the sleeve holder 40. In the figure, a schematic sectional view of the supporting portion 84 is depicted. In this case, the positions of the cathode structure 30 supported by the supporting portion 84 and the sleeve holder 40 can be adjusted in the vertical direction by rotating the thimble 83*b* of the micro-meter 83 so as to vary a protruding amount of the spindle 83*a* of the micro-meter 83.

The grid fixing member 70 is mounted to the opening of the table 64 in the grid position adjustment jig 60. The grid fixing member 70 includes a table 71 to receive the first grid 11 and a supporting lever 72 for supporting the first grid 11 mounted on the table 71. The grid aperture 11*h* of the first grid 11 is open condition at the table 71.

The grid fixing member 70 is mounted on the grid position adjustment jig 60 and the grid position adjustment jig 60 is further mounted on the cathode structure supporting jig 80 so that the sleeve ring 22 of the ceramic substrate 20 mounted on the first grid 11 becomes to be on a side of the cathode structure supporting jig 80. Further the position of the grid fixing member 70 is adjusted by the micro-meters 65 and 67 and the cathode 31 of the cathode structure 30 supported by the supporting portion 84 is fixed to be detected by the measuring machine 58 through the grid apertures 11*h*-R, 11*h*-G and 11*h*-B of the first grid 11.

Figure 7A:
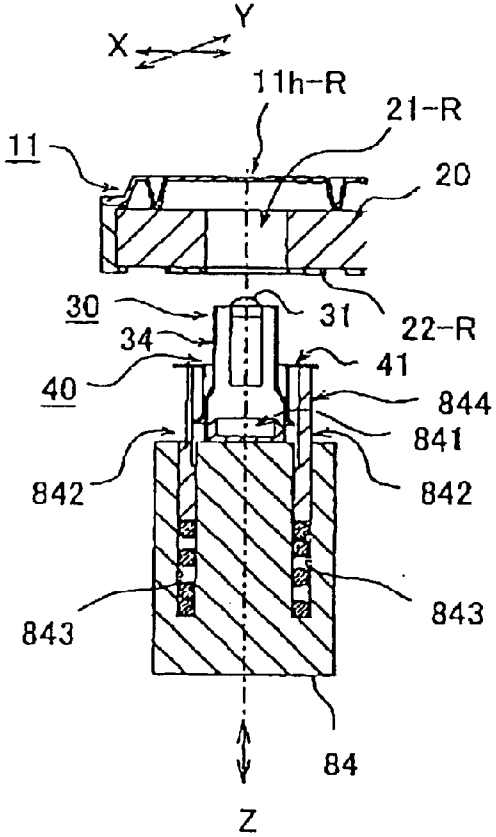
FIGS. 7A to 7D are charts showing a process for assembling the cathode structure.

FIGS. 7A to 7D are charts for explaining mounting operations of fixing the cathode structure 30 on the first grid 11 by the cathode fixing jig 50. As shown in FIG. 7A, a cathode structure supporting portion 841 for fixing the position of the cathode structure 30 at a center of a tip of the supporting portion 84 provided on the cathode structure supporting jig 80. Further a groove 842 is formed around the cathode structure supporting portion 841 and a resilient member such as a coil spring 843 is loosely inserted in the groove 842. A movable supporting member 844 is provided to slidably support the collar portion 41 of the sleeve holder 40 in the vertical direction (the Z direction in the figure), wherein the movable supporting member 844 is loosely inserted in the in the groove 842 in which the coil spring 843 is loosely inserted.

In this case, when the cathode structure 30 is mounted on the first grid 11, the cathode structure 30 is supported by fixing its position by the cathode structure supporting portion 841, and also, the collar portion 41 of the sleeve holder 40 is supported by the movable supporting member 844. Further, the apex point of the cathode 31 provided at a tip of the cathode structure 30 supported by the supporting portion 84 is detected by the measuring machine 58 by way of the grid aperture 11*h*-R, for example, of the first grid 11.

A measuring machine capable of detecting the apex point of the cathode 31 such as a focal depth measuring machine or a three dimensional surface form measuring machine which can detect the apex point by applying interference between an irradiating light and a reflecting light are used as a measuring machine 58.

A positioning adjustment to execute a fine adjustment of a position of the first grid 11 by the micro-meters 65 and 67 so that the apex point of the cathode 31 detected by the measuring machine 58 becomes a center of the grid aperture 11*h*-R.

Figure 7B:
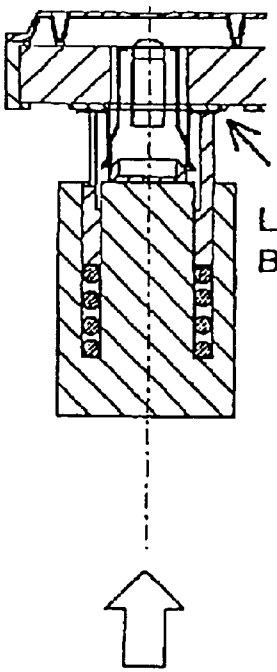

Next, when a fine adjustment of the position of the first grid 11 is completed, the sleeve ring 22 provided on the ceramic substrate 20 and the collar portion 41 of the sleeve holder 40 are bonded by moving the supporting portion 84 in a direction of the first grid 11 as designated by an arrow in FIG. 7B by operating the micro-meter 83. Further, the sleeve ring 22 and the sleeve holder 40 are laser-welded by irradiating a laser beam on this bonding surface from laser output apparatuses 53-1, 53-2 and 53-3.

Figure 7C:
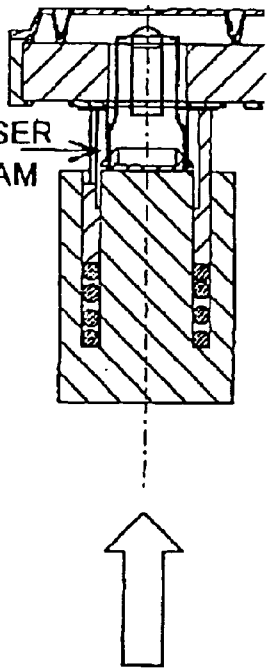

When the laser welding process for the sleeve ring 22 and the sleeve holder 40 is completed, a dgk-value (dimension between a grid and a cathode) designating a distance between the surface of the first grid 11 and the apex point of the cathode 30 is adjusted to be a predetermined value by further moving the supporting portion 84 in the direction of the first grid 11 as designated by an arrow in FIG. 7C by further operating the micro-meter 83.

In this case, when the height of the apex point is constant, the dgk-value is easily adjusted to be a predetermined value based on the designated value of the micro-meter 83 with the position of the surface of the first grid 11 as a reference position of the micro-meter 83. Further when there is dispersion in the height of the apex points, the apex point is detected by the measuring machine 58, and the dgk-value adjustment process is executed to be a predetermined value by measuring the position of the apex point and the surface of the first grid 11.

When the dgk-value adjustment process is completed, the second sleeve 34 and the sleeve holder 40 are laser-welded by irradiating the laser beam from the laser output apparatus 55-1, 55-2 and 55-3 on the superposed position of the second sleeve 34 of the cathode structure 30 and the sleeve holder 40. In this case, the cathode structure 30 is to be fixed to the first grid 11 through the sleeve holder 40. Further stress applied to a laser-welded portion of the sleeve ring 22 and the sleeve holder 40 is avoided because the movable supporting member 844 is to be sliding in the groove 842, even if the supporting portion 84 is moved in a direction of the first grid 11 after the laser-welding of the sleeve ring 22 and the sleeve holder 40.

Figure 7D:
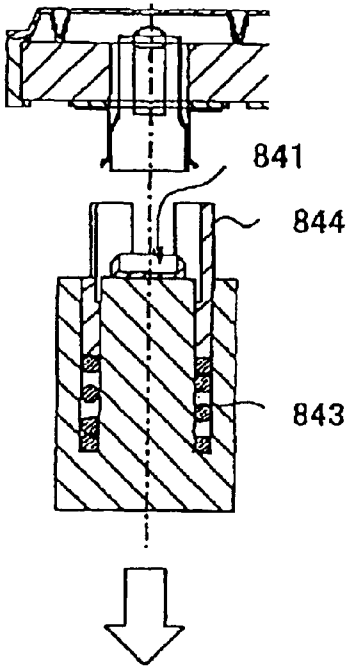

Further when the fixing of the cathode structure 30 to the first grid 11 is completed, the supporting portion 84 is moved to a position opposite to the first grid 11 as shown in FIG. 7D by the micro-meter 83.

After that, another cathode structure 30 is mounted to the supporting portion 84 and the first grid 11 is moved to the X direction so that another grid aperture is positioned at the cathode structure 30 supported on the supporting portion 84 and a sequential set of above-described processes as shown in FIG. 7A to FIG. 7D is again executed.

Figure 8:
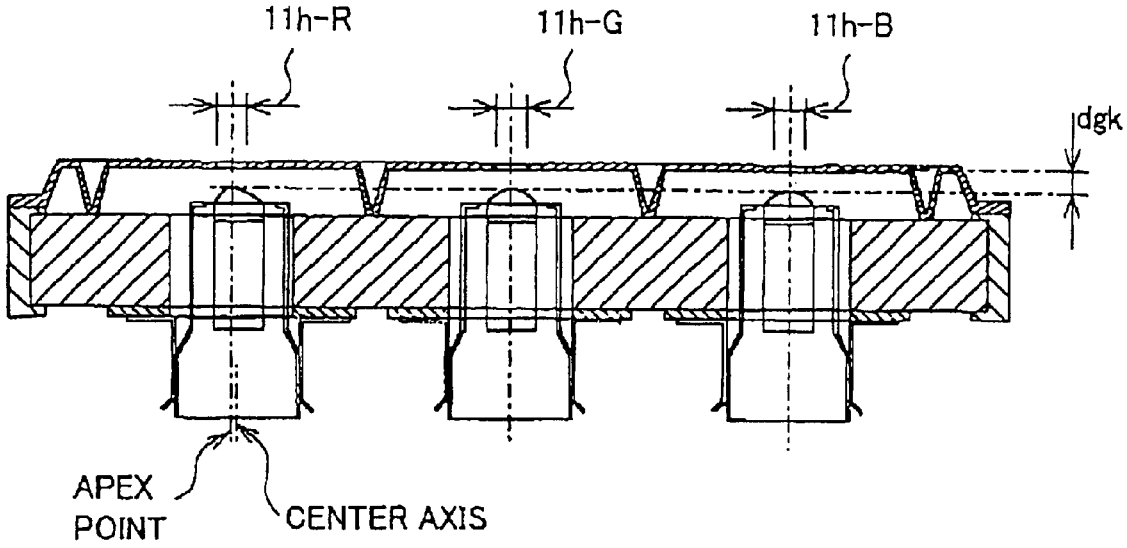
FIG. 8 is a schematic sectional view of a first grid on which the cathode structure is mounted.
Figure 9:
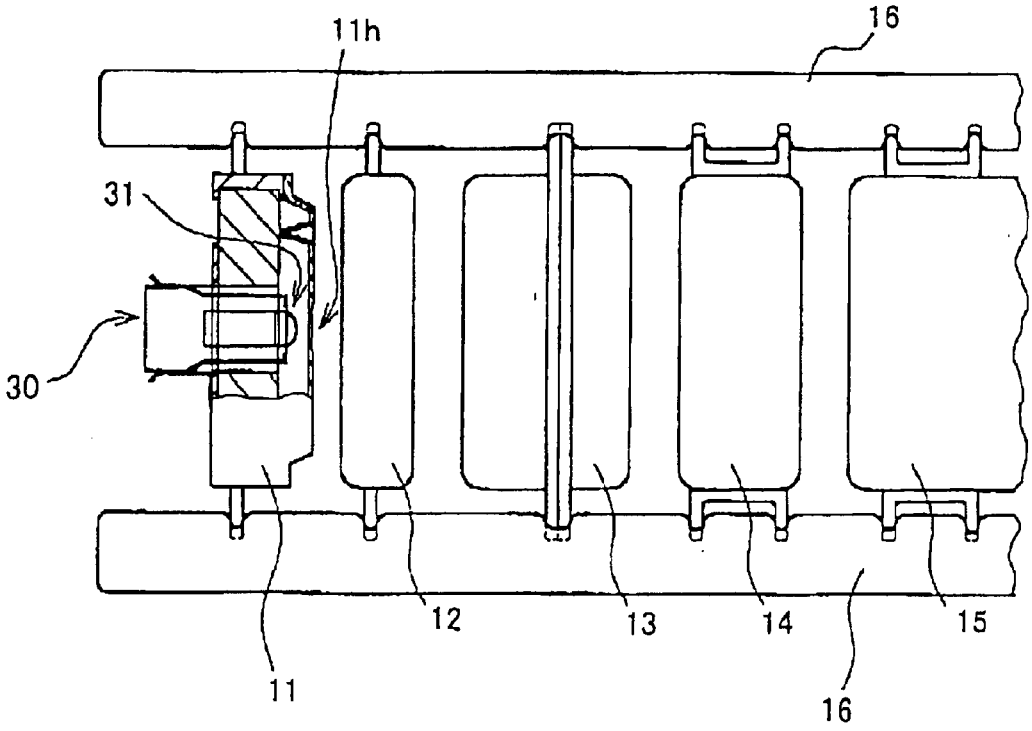
FIG.9 PRIOR ART
FIG. 9 is a partial side view of the electron gun.

As described above, the sleeve ring 22 and the sleeve holder 40 are welded together by the laser beam after the centers of the grid apertures 11*h*-R, 11*h*-G, and 11*h*-B are adjusted to be coincided with the apex point by detecting the apex point of the cathode 31. Further, the sleeve holder 40 and the cathode structure 30 are welded together by the laser beam after adjusting the gap between the first grid 11 and the apex point to be a predetermined value. Accordingly as shown in FIG. 8, even if there are dispersion in the cathode structure 30 to be fixed to the position of the grid aperture 11*h*-R and the center axis of the grid aperture 11*h*-R is not coincided with the position of the apex point, it is possible to adjust the position of the apex point with the center of the grid aperture 11*h* and further to mount the cathode 31 so that the gap between the first grid 11 and the apex point becomes a predetermined value.

In this case in the above-described embodiment, the sleeve holder 40 and the cathode structure 30 are welded after welding the sleeve ring 22 and the sleeve holder 40, but the sleeve ring 22 and the sleeve holder 40 is able to be welded with a predetermined gap between the first grid 11 and the apex point of the cathode 31 after welding the sleeve holder 40 and the cathode structure 30 by adjusting the center of the grid aperture 11*h* and the apex point of the cathode 31.

Further the above-mentioned cathode fixing jig and the grid position adjustment jig are just employed as exemplified models and not limited to the embodiments. In addition, the positional adjustment for the first grid and the position adjustment for the cathode structure are possible to be automated by utilizing signals from the measuring machine or the like.

As described above, a positional adjustment process of the position of the apex point of the cathode and the center of the grid aperture on the first grid is independently done on the dgk-value adjustment process for positioning the gap between the detected position of the apex point of cathode and the first grid to be a predetermined value. Accordingly, even a coating type cathode having dome shaped surface is employed, mounting operation of the cathode onto the first grid is accomplished with high precision.

What is claimed is:

1. An electron gun of a cathode ray tube, comprising:

a ceramic substrate having at least one in insertion aperture formed therethrough;

at least one sleeve ring formed with an opening extending therethrough and connected to the ceramic substrate with the at least one opening and the at least one in insertion aperture coaxially aligned along a common axis;

a cathode structure including a first sleeve, a cathode mounted to a distal end of the first sleeve and a second sleeve sized to receive and retain the first sleeve therein with the cathode mounted thereto; and a sleeve holder connected to the at least one sleeve ring and forming a conduit sized to slidably receive the cathode structure in a manner such that the sleeve holder and the second sleeve are fixedly connected to each other.

2. The electron gun as cited in claim 1, wherein the sleeve holder and the at least one sleeve ring are welded together.

3. The electron gun as cited in claim 2, wherein the sleeve holder and the second sleeve are welded together.

* * * * *